United States Patent [19]

Enriquez et al.

[11] Patent Number: 4,482,032

[45] Date of Patent: Nov. 13, 1984

[54] ELEVATOR EMERGENCY CONTROL SYSTEM

[75] Inventors: Emanuel E. Enriquez; Robert C. MacDonald, both of West Caldwell, N.J.

[73] Assignee: Westinghouse Electric Corp., Pittsburgh, Pa.

[21] Appl. No.: 488,340

[22] Filed: Apr. 25, 1983

[51] Int. Cl.[3] ..... B66B 5/00

[52] U.S. Cl. ..... 187/29 R; 340/19 R

[58] Field of Search ..... 187/29; 340/19–21; 364/513; 381/43

[56] References Cited

U.S. PATENT DOCUMENTS

| | | | |
|---|---|---|---|
| 2,602,524 | 7/1952 | Shirley | 187/29 R |
| 2,776,732 | 1/1957 | Eames | 340/19 R X |
| 3,388,376 | 6/1968 | Magee | 187/29 R |
| 3,677,370 | 7/1972 | Devine | 340/19 R X |
| 4,144,582 | 3/1979 | Hyatt | 364/513 |
| 4,388,495 | 6/1983 | Hitchcock | 381/43 |

*Primary Examiner*—J. V. Truhe
*Assistant Examiner*—W. E. Duncanson, Jr.
*Attorney, Agent, or Firm*—D. R. Lackey

[57] ABSTRACT

An emergency control system for use in an elevator system. When an emergency situation arises in an elevator car, an elevator passenger recites a code word. A microphone in the elevator car transforms the vocal signal to an electrical signal, and using a voice-recognition system, the spoken code word is compared with a code word stored in memory. If the spoken code word matches the stored code word, control of the elevator system is switched to an emergency mode. In this mode the elevator car is brought to a predetermined landing and an intercom system providing communication between the elevator car and the guard station is activated. At the predetermined landing, security personnel are available to render assistance to the elevator passenger when the elevator doors open.

7 Claims, 7 Drawing Figures

ELEVATOR EMERGENCY CONTROL SYSTEM

BACKGROUND OF THE INVENTION

1. Field of the Invention

This invention relates generally to elevator emergency control systems, and more particularly, to emergency elevator control systems activated by a voice signal within the elevator car.

2. Description of the Prior Art

Although the chief responsibility of the elevator attendant in older elevator systems was to operate the elevator car, the elevator attendant also provided a degree of security by limiting access to authorized, or at least familiar, passengers. Also, the elevator attendant performed the function of visual surveillance within the elevator car; as a result, no passenger was ever alone in the car. The attendant could assist in preventing criminal acts against a passenger and render assistance during medical emergencies.

With today's elevator systems, a passenger entering an elevator car may be alone or temporarily confined with a stranger until the car stops and the door opens on another floor. To provide passenger security in modern elevators, closed-circuit television cameras have been mounted within the elevator car with a television monitor located at a traffic director's station, for example.

A feature known as "Emergency Return" has been in use since the late 1950's; it is activated by a pushbutton or switch external to the car or cars. This feature, when activated, cancels any car calls and expedites the elevator car or cars to a designated landing, bypassing intervening hall calls. Because this system is activated by a switch external to the elevator cars, it is most beneficial for emergency situations arising outside the car. The system is not immediately helpful for an elevator passenger who suffers a medical emergency or is the victim of a criminal act inside an elevator car.

Another arrangement that may be used serves each car call before responding to another hall call. This would prevent an assailant from entering an elevator car carrying a passenger upon whom an assault can be performed. This system would be useful, however, only during periods of light elevator traffic, to ensure that only empty elevator cars respond to hall calls. Also, this system cannot respond to medical emergencies occurring within an elevator car.

Patent application Ser. No. 411,792, filed Aug. 26, 1982 (and an improvement thereon in U.S. patent application Ser. No. 457,788, filed Jan. 13, 1983), both of which are assigned to the same assignee as the present invention, discloses an elevator security system operated by voice recognition. This system screens potential elevator passengers by requiring that a voice signal from a potential elevator passenger match a previously-stored voice signal of all authorized elevator passengers. If a match occurs, the potential elevator passenger is designated as an authorized passenger and is provided access to the elevator system. Like the patents discussed above, this elevator control system is activated externally to the elevator car and therefore cannot provide emergency control for problems arising within an elevator car.

The present invention overcomes these disadvantages in the prior art by providing an elevator emergency control system activated from within an elevator car by the user's voice signal. These and other advantages of the present invention are discussed below in the

DESCRIPTION OF THE PREFERRED EMBODIMENTS.

SUMMARY OF THE INVENTION

A voice-controlled elevator emergency control system is disclosed. When an emergency situation arises in an elevator car, the user provides a voice signal that is sensed by a microphone within the car and is converted to an electrical signal. Using a voice-recognition system, the electrical signal is compared with a secret code word stored in a memory. If the user's spoken word matches the stored code word, emergency-made operation of the elevator car begins. In the emergency mode, the elevator car is returned to a predetermined landing, usually the main floor, where security personnel are present to render assistance. Also, in this mode an audible alarm at the traffic director's station is triggered, the emergency stop button and car call switches are disabled, and hall calls are bypassed.

DESCRIPTION OF THE PREFERRED EMBODIMENTS

Figure 1:
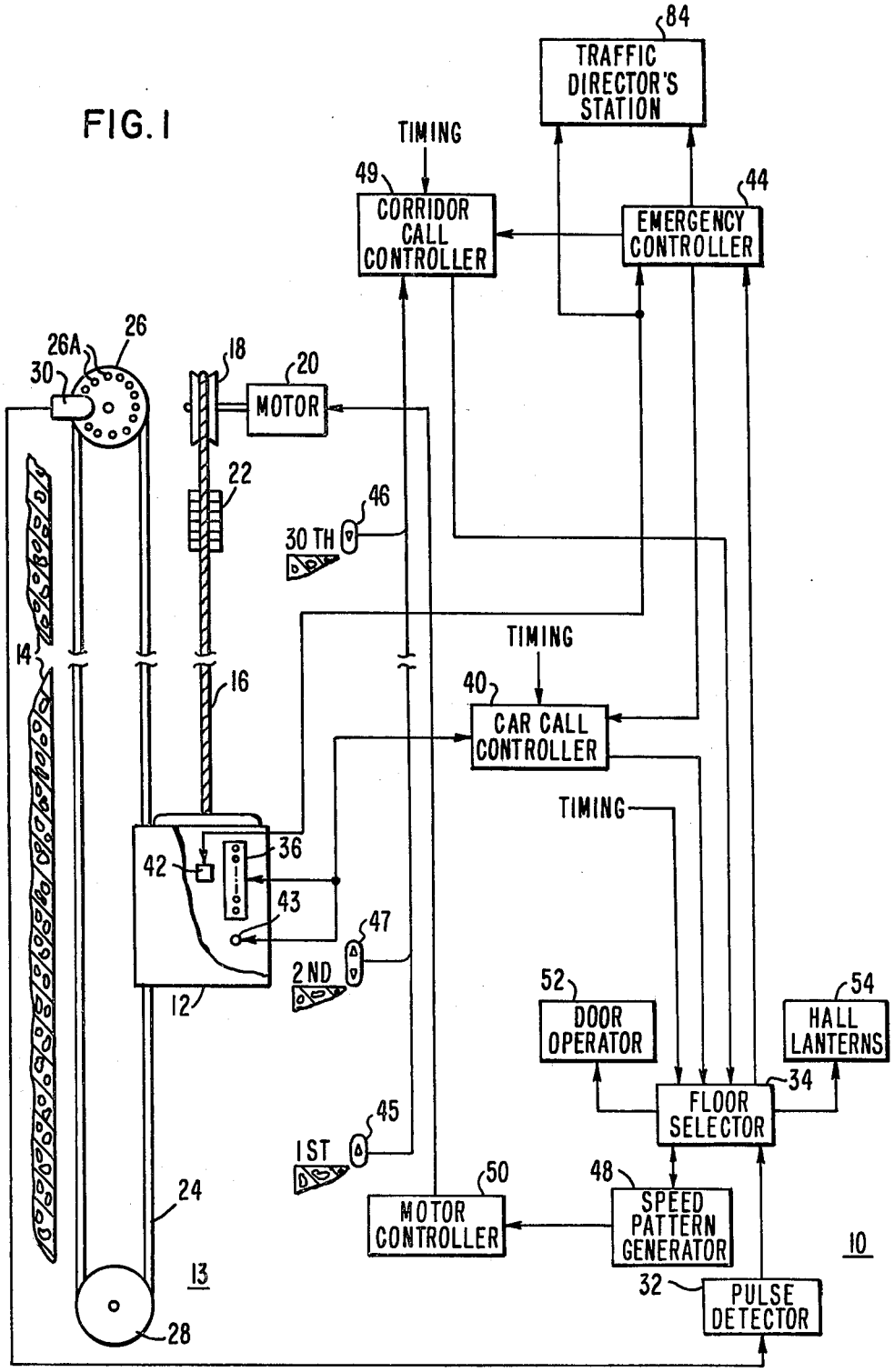
FIG. 1 is a block diagram of an elevator system constructed according to the teachings of the present invention.

Referring now to FIG. 1, there is shown an elevator system 10 wherein an elevator car 12 is mounted in a hatchway 14 for movement relative to a structure 13. The structure 13 has a plurality of landings, such as thirty, with only the first, second, and the thirtieth landings shown to simplify FIG. 1. Elevator car 12 is supported by a rope 16 that is reeved over a traction sheave 18 mounted on the shaft of a drive motor 20. A counterweight 22 is connected to the other end of the rope 16. A governor rope 24 is connected to the top and bottom of the elevator car 12. The governor rope 24 is reeved over a governor sheave 26 located above the highest point of travel of the elevator car 12 in the hatchway 14, and over a pulley 28 located at the bottom of the hatchway 14. A pickup 30 is disposed to detect movement of the elevator car 12 through the effect of circumferentially spaced openings 26A in the governor sheave 26. The openings 26A in the governor sheave 26 are spaced to provide a pulse for each standard increment of travel of the elevator car 12, such as a pulse for each 0.5 inch of car travel. The pickup 30, which may be of any suitable type including optical or magnetic, provides pulses in response to the movement of the openings 26A in the governor sheave 26. The pickup 30 is connected to a pulse detector 32 that provides distance pulses to a floor selector 34.

Car calls, as registered by a car call selector 36 mounted in the elevator car 12, are recorded and serialized in a car call controller 40. A voice-recognition terminal 42 is also mounted in the elevator car 12. The voice-recognition car terminal 42, which includes a microphone and speaker not shown in FIG. 1, provides a signal to an emergency controller 44 and is bidirectionally responsive with a traffic director's station 84. An emergency stop button 43 is also mounted in the elevator car 12. When depressed, the emergency stop button 43 provides a signal to the car call controller 40 for stopping the elevator car 12. The emergency stop button 43 is responsive to the emergency controller 44. The car call controller 40 is also responsive to an externally generated timing signal for serializing the car calls.

Corridor calls are registered by pushbuttons mounted in the corridors of each landing served by the elevator system 10. In FIG. 1 there is shown an up pushbutton 45 located at the first landing, a down pushbutton 46 located at the thirtieth landing, and up and down pushbuttons 47 located at the second landing. Corridor calls are recorded and serialized in a corridor call controller 49. The corridor call controller 49 is also responsive to externally generated timing signals for serializing the hall calls.

When an emergency situation arises in the elevator car 12 (such as molestation of an elevator passenger or a medical emergency), the passenger says a code word that is transformed to an electrical signal by the microphone in the voice-recognition terminal 42. The electrical signal is input to the emergency controller 44 where the passenger's voice signal is compared with a stored code word. If the passenger's voice signal matches the stored code word, the emergency controller 44 masks the car and corridor calls, disables the stop pushbutton 43, causes the elevator car 12 to move to a predetermined landing of the structure 13, provides an emergency signal at the traffic director's station 84, and activates an intercom (not shown in FIG. 1) between the elevator car 12 and the traffic director's station 84. To mask the hall calls, the emergency controller 44 inputs a signal to the corridor call controller 49; to mask the car calls the emergency controller 44 inputs a signal to the car call controller 40. A floor selector 34 provides a signal to the emergency controller 44 indicating the position and travel direction of the elevator car 12. The emergency controller will be discussed in more detail subsequently.

The floor selector 34 processes the distance pulses from the pulse detector 32 to develop information regarding the position of the elevator car 12 in the hatchway 14. The floor selector 34 also directs the processed distance pulses to a speed pattern generator 48 that generates a speed reference signal for a motor controller 50, which in turn provides the drive voltage for the motor 20. The floor selector 34 monitors the position of the elevator car 12 in the hatchway 14, and monitors calls for service from the corridor call controller 49 and the car call controller 40. The floor selector 34 provides an acceleration signal to the speed pattern generator 48, and a deceleration signal to the speed pattern generator 48 at the precise time required for the elevator car 12 to decelerate according to a predetermined deceleration pattern, allowing the elevator car 12 to stop at the landing for which a call for service has been registered. The floor selector 36 also provides a signal to a door operator 52 for opening and closing a door (not shown in FIG. 1) of the elevator car 12 at the appropriate time. The floor selector 34 also controls the hall lanterns shown generally by character reference 54 in FIG. 1. The floor selector 34 is also responsive to a timing signal for ensuring that the floor selector 34 operates in the proper time sequence. A detailed description of the floor selector can be found in U.S. Pat. No. 3,750,850, which is assigned to the assignee of the present invention.

Figure 2:
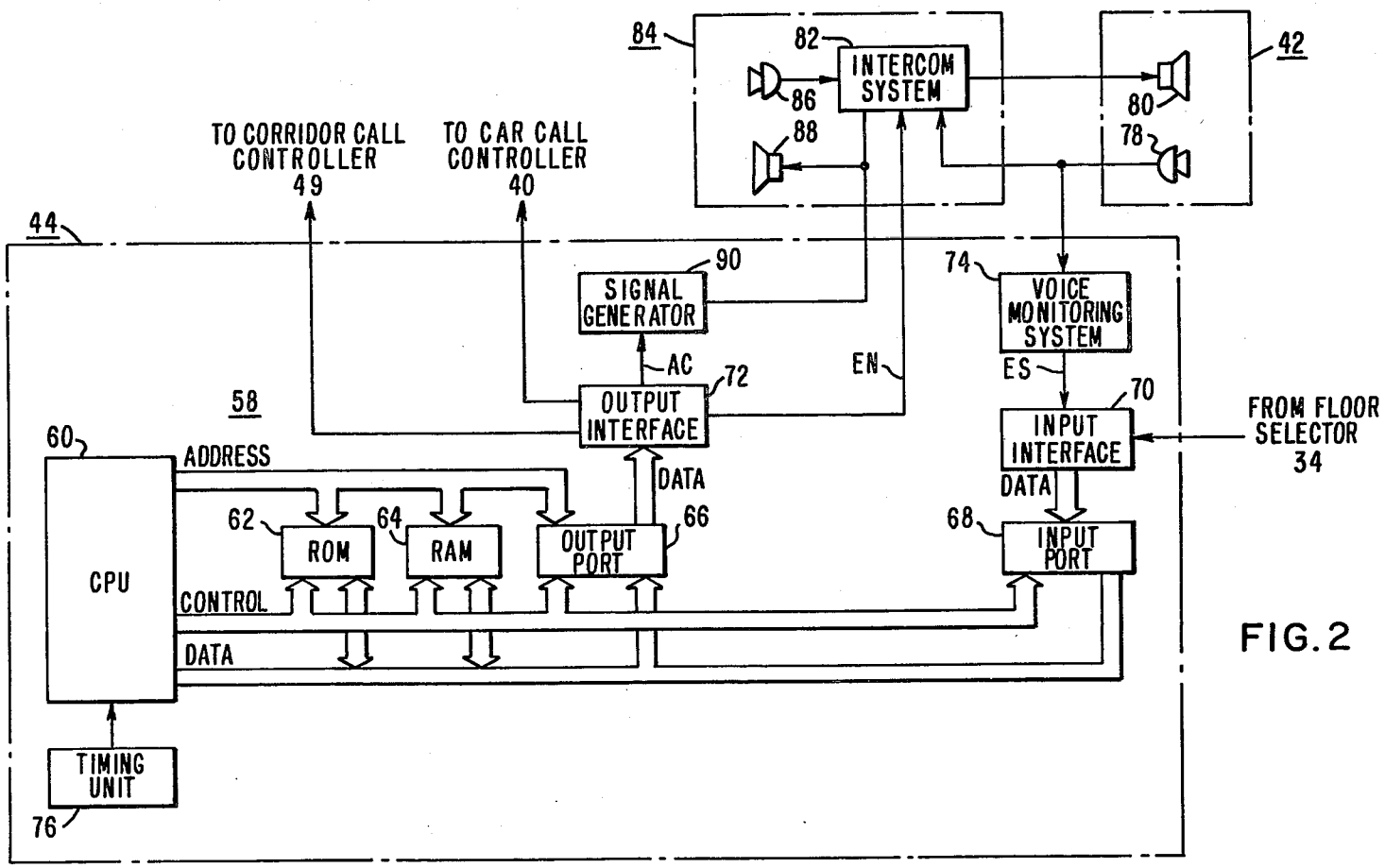
FIG. 2 is a block diagram of the emergency controller of FIG. 1.

The emergency controller 44 can be implemented by a digital computer, more specifically, by a microcomputer. FIG. 2 is a block diagram of a microcomputer 58 that may be used.

Specifically, the microcomputer 58 includes a central processing unit (CPU) 60, a read-only memory (ROM) 62, a random-access memory (RAM) 64, a timing unit 76, an output port 66 for communicating with a suitable output interface 72, and an input port 68 for communicating with a suitable input interface 70. The CPU 60 communicates with the ROM 62, the RAM 64, and the output port 66 via an address bus shown in FIG. 2. Control is provided from the CPU 60, via the control bus, to the ROM 62, the RAM 64, the output port 66, and the input port 68. The ROM 62 communicates bidirectionally with the CPU 60 via the data bus; the RAM 64 also communicates bidirectionally with the CPU 60 via the data bus. Data from the CPU 60 is transmitted to the output interface 72 via the data bus and the output port 66. Incoming data from the input interface 70 is conducted to the CPU 60 via the input port 68 and the data bus. The timing unit 76 provides appropriate timing signals to the CPU 60.

As illustrated in FIG. 2, the voice-recognition terminal 42 located in the elevator car 12 includes a microphone 78 and a speaker 80. The microphone 78 should be a high quality cardioid directional type of eliminate noise interference from outside the elevator car 12. The voice-recognition terminal 42 can also include a preamplifier to improve the signal-to-noise ratio of the electrical signal produced by the microphone 78. Also, the conductor connecting the microphone 78 to the voice-monitoring system 74 should be a shielded-twisted pair to further reduce noise interference.

When an elevator passenger experiences an emergency situation, the passenger says a code word that is transformed to an electrical signal by the microphone 78. In the voice-monitoring system 74 the electrical signal representing the code word is compared with a code word stored in a memory (not shown in FIG. 2) of the voice-monitoring system 74. Any one of the several well-known voice-recognition systems can be used to make the comparison. If sufficient memory space is available, various accents of the code word can be stored to ensure more accurate comparison of the code word spoken by the passenger with the code word stored in memory. Also, if sufficient memory is available, more than one code word can be used. If the code word spoken by the passenger matches the code word stored in memory, the voice-monitoring system 74 produces an emergency signal, ES, that is input to the input interface 70. As discussed in conjunction with FIG. 1, the input interface 70 is also responsive to a signal providing information about the location and travel direction of the elevator car 12 from the floor selector 34.

Upon receipt of the signal ES, the microcomputer 58 produces an enable signal for enabling an intercom system 82 via the output interface 72. The enable signal is designated EN in FIG. 2. The intercom system 82 is located at the traffice director's station 84. When enabled, the intercom system 82 provides bidirectional communication between the elevator car 12 and the traffic director's station 84. (In an alternative embodiment not illustrated in FIG . 2, the intercom system 82 can be located at any or all landings of the structure 13 to allow anyone on the landing to communicate with the elevator passenger.) The microphone 78 transforms the passenger's acoustical voice signal into an electrical signal. The electrical signal is amplified in the intercom system 82 and conducted to a speaker 88 located in the traffic director's station 84. For communication in the other direction, the traffic director uses a microphone 86 that provides a signal to the speaker 80 via the intercom system 82.

Also, the microcomputer 58 produces an alarm activate signal, AC, to a signal generator 80. The signal AC activates the signal generator 80 to produce an alarm signal at the speaker 88 in the traffic director's station 84. Lastly, the output interface 72 provides signals to the car call controller 40 and the corridor car controller 49 for masking the hall calls and car calls and for disabling the emergency stop button 43.

Figure 3:
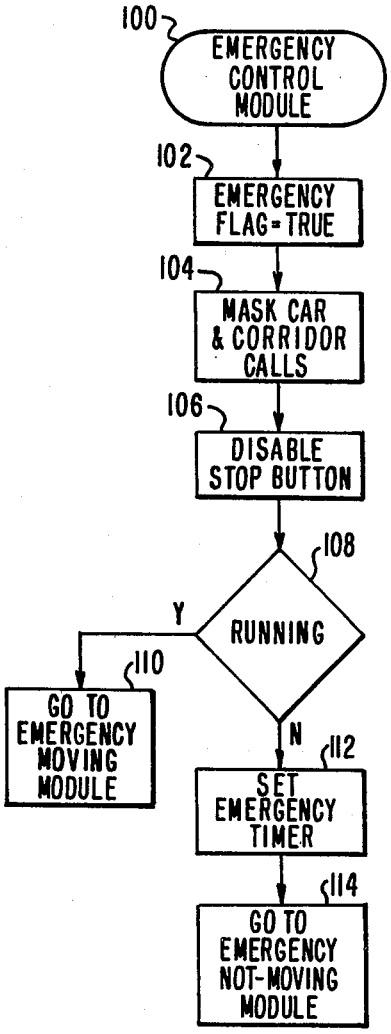
FIGS. 3–5 are software flowcharts illustrating the programming of the microprocessor shown in FIG. 2.
Figure 4:
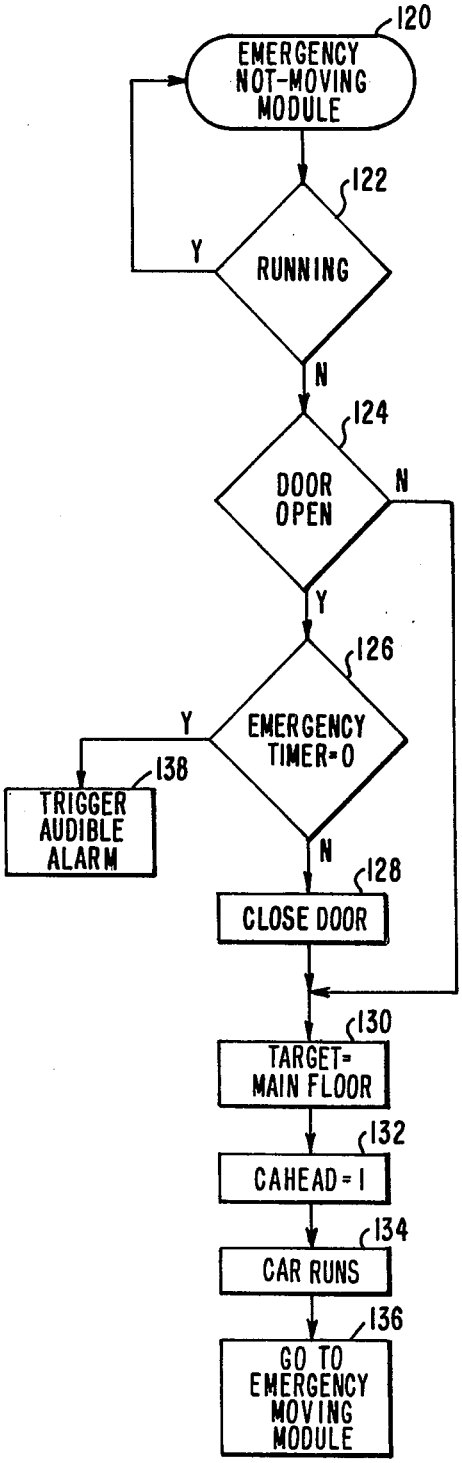
Figure 5:
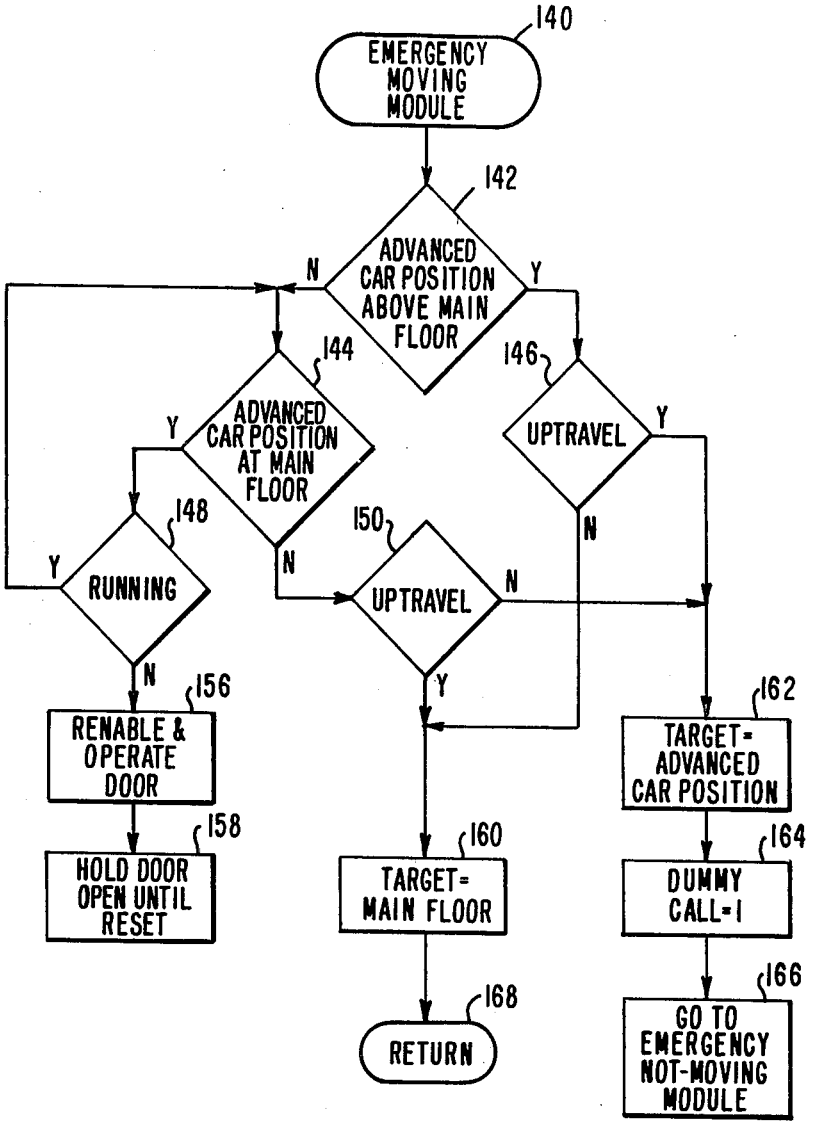

Programming of the microcomputer 58 of FIG. 2 is illustrated by the software flowcharts of FIGS. 3, 4, and 5. The FIG. 3 flowchart illustrates a control module for programming the microcomputer 58. The modules of FIGS. 4 and 5 set the necessary parameters to supervise motion of the elevator car 12, avoid stops between landings, and express the elevator car 12 to the main floor when an emergency arises. When the voice-monitoring system 74 produces the enable signal shown in FIG. 2, the microcomputer 58 begins processing the emergency control module at an entry step 100 thereof. At a step 102 of the emergency control module, an emergency flag is set to true. This emergency flag is used by other software programs operating the elevator system 10 of FIG. 1. At a step 104 the car and corridor calls are masked and at a step 106 the emergency stop button in the elevator car 12 is disabled. At a decision step 108 it is determined whether the elevator car 12 is running. If the elevator car 12 is not running, an emergency timer is set at a step 112 and processing continues with the emergency not-moving module at a step 114. If the elevator car is running, processing goes to the emergency moving module at a step 110.

FIG. 4 illustrates the emergency not-moving module referred to in FIG. 3. The emergency not-moving module is entered at an entry step 120 and processing continues to a decision 122 where a determination is made regarding whether the elevator car 12 is running. Although this determination was previously made at the decision step 108 of FIG. 3, it is necessary to repeat it in the emergency not-moving module because the emergency not-moving module may be entered from points other than the step 114 of FIG. 3. If the car is moving, processing returns to the entry step 120. When the car stops, processing continues to a step 124 where the door status is checked. If the door is open, processing continues at a decision step 126 where the emergency timer (set at the step 112 of FIG. 3) is checked to see if it has timed out to zero. If the emergency timer, which is set for only a few seconds, has timed out, processing moves to a step 138 where an audible alarm is triggered, via the signal generator 80, at the traffic director's station 84 (see FIG. 2). The audible alarm indicates that the doors are being held open by a molester and allows the traffic director to take the appropriate action.

If the elevator door is open but the emergency timer has not timed out to zero, the door is closed at a step 128. Closing the door ensures that the molester remains in the elevator car while the elevator car 12 is moving to the main floor staffed with security personnel. If the elevator door is closed, as determined at the decision step 124, or the door is closed at the step 128, processing moves to a step 130 where the target floor is set for a predetermined landing of the structure 13. In the flowchart of FIG. 4 this predetermined landing is the main floor. After the target floor is set, processing moves to a step 132 where a variable CAHEAD is set equal to one. This variable indicates there is a call ahead of the car and is used by other program modules operating the elevator system 10. Movement of the elevator car 12 to the main floor is indicated by a step 134. Processing then goes to the emergency moving module at a step 136.

The emergency moving module is illustrated in FIG. 5. The emergency moving module is entered from the step 110 of FIG. 3 (if the car is running when the emergency occurs) or from the step 136 of the emergency not-moving module. The emergency moving module is entered at an entry step 140 and processing continues to a decision step 142. At the decision step 142 it is determined whether the advanced car position is above the main floor. If the advanced car position is above the main floor, the direction of travel is determined at a decision step 146. If the elevator car is moving down, the target floor is set equal to the main floor at a step 160. If the elevator car 12 is moving up, at a step 162 the target floor is set equal to the advanced car position floor and at a step 164 a variable DUMMY CALL is set equal to one. This variable is also used by other program modules. The purpose of the step 162 is to smoothly stop the elevator car 12 as soon as possible (i.e., at the advanced car position) and then return the elevator car 12 to the main floor. This feature of stopping at the advanced car position and returning the elevator car 12 to the main floor is the well-known fireman's-return feature. Return of the elevator car 12 to the main floor is accomplished in the emergency not-moving module of FIG. 4, via a step 166.

If the advanced car position is not above the main floor, processing progresses from the decision step 142 to a decision step 144 where it is determined whether the advanced car position is at the main floor. If the advanced car position is not at the main floor, processing moves to a decision step 150. At the decision step 150 it is determined whether the elevator car 12 is traveling up or down. If the result at the decision step 150 is negative, indicating that the elevator car 12 is below the main floor and traveling down, processing moves to the step 162 where the target floor is set to the advanced car position, as previously discussed. Now, when the elevator car 12 reaches the advanced car position it stops, and through the emergency not-moving module, begins traveling up until it reaches the main floor. If the result at the decision step 150 is affirmative, indicating that the car is traveling up from below the main floor, processing moves to a step 160 where the target floor is set equal to the main floor. After the step 160, the program continues to the entry step 140 via a return step 168.

Returning to the decision step 144, if the advance car position is at the main floor, processing moves to a decision step 148 where a determination is made whether the elevator car 12 is running. If the elevator car 12 is running, processing loops back to the decision step 144 and through the decision step 148 until the elevator car 12 stops and the result at the decision step 148 is negative. When this condition occurs, the emergency controller 44 is reenabled and the elevator door is operated at a step 156. At this point the elevator car 12 is at the main floor and security personnel should have been dispatched to render assistance to the elevator passenger or take the molester into custody when the elevator door opens. A step 158 indicates that the elevator door is held open until reset.

The discussion of the software flowcharts of FIGS. 3, 4, and 5 is intended for purposes of illustration and not limitation. It is anticipated that alternative embodiments of the present invention may be conceived wherein the location of the instructions for performing emergency control over the elevator car 12 is different from that shown in the discussed flowcharts. These alternative embodiments are believed to fall within the spirit and scope of the present invention as claimed hereinafter.

As described above, the modules of FIGS. 3, 4, and 5 are discussed in conjunction with a dedicated microcomputer 58. It is recognized, however, that in an alternative embodiment of the present invention, these modules can be processed by a microprocessor that controls other aspects of the elevator system 10. In this situation, the modules would be processed when an elevator passenger experiences an emergency situation and provides the proper code word. To run these modules on a non-dedicated microcomputer requires a bid table so that the modules are processed in accordance with the priority of each. Such a bid table is described in U.S. Pat. No. 4,240,527 (which is assigned to the assignee of the present invention) and in patent application Ser. No. 447,059, filed Dec. 6, 1982 (also assigned to the assignee of the present invention).

Figure 6:
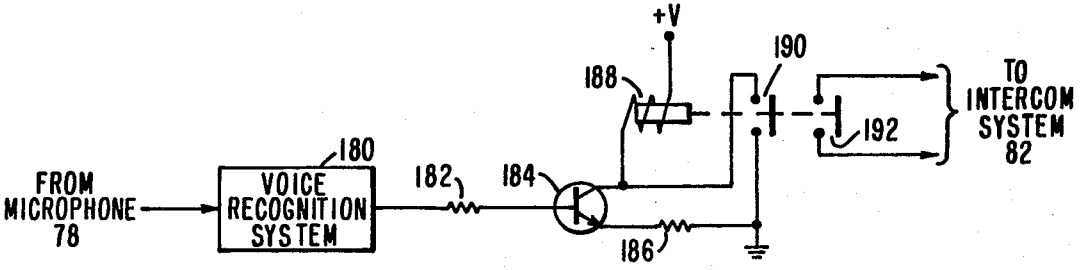
FIG. 6 is a schematic diagram of a first alternative embodiment of the emergency controller of FIG. 1.

FIG. 6 illustrates an alternative embodiment for enabling the intercom system 82 of FIG. 2, without the use of a microcomputer 58. A voice-recognition system 180 receives a signal from the microphone 78 (see FIG. 2). An output terminal of the voice-recognition system 180 is connected to a base terminal of a transistor 184 via a resistor 182. An emitter terminal of the transistor 184 is connected to ground via a resistor 186; a collector terminal of the transistor 184 is connected to a positive supply voltage via a relay coil 188. A relay contact 190 is connected between the collector of the transistor 184 and ground. A relay contact 192 is connected to the intercom system 82 for enabling the intercom system 82 when the relay contact 192 is closed. The relay contacts 190 and 192 are closed when the relay coil is energized.

In operation, when the code word spoken by an elevator passenger experiencing an emergency situation matches the code word stored in a memory (not shown) of the voice-recognition system 180, the voice-recognition system 180 produces a signal that forward biases and therefore turns on the transistor 184. The voice recognition system 180 uses a matching process; such devices are well-known in the art. When the transistor 184 is on, the relay coil 188 energizes through the positive power supply voltage and the relay contacts 190 and 192 close. This enables the intercom system 82 to allow the passenger to communicate bidirectionally with the traffic director at the traffic director's station 84. The relay contact 190 is a latching contact that keeps the relay coil 188 energized, because after the process of matching the spoken code word with the code words in memory is completed the transistor 184 turns off.

Figure 7:
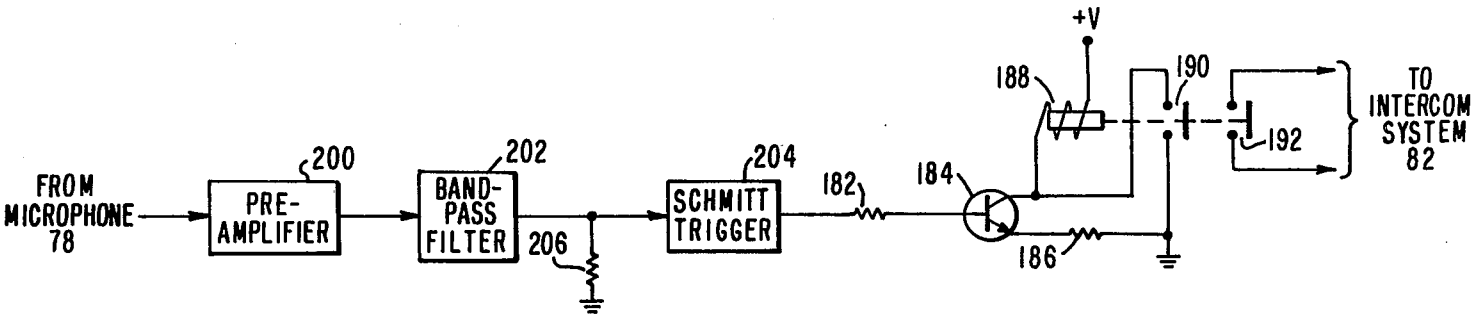
FIG. 7 is a schematic diagram of a second alternative embodiment of the emergency controller of FIG. 1.

FIG. 7 illustrates another embodiment for activating the intercom system 82. The components in FIG. 7 are identical in structure and function to the components bearing identical reference characters in FIG. 6. In FIG. 7 a preamplifier 200 is responsive to the signal from the microphone 78. An input terminal of a bandpass filter 202 is connected to an output terminal of the preamplifier 200. An output terminal of the bandpass filter 202 is connected to ground via a resistor 206 and to an input terminal of a Schmitt trigger 204. The resistor 182 is connected between an output terminal of the Schmitt trigger 204 and the base terminal of the transistor 184.

In operation, an electrical signal from the microphone 78 is preamplified to increase the signal-to-noise ratio in the preamplifier 200. The bandpass filter 202, in one embodiment of the invention, is a 12 dB passband filter for limiting the frequency range of the signal input thereto to approximately 300 to 3400 Hz. This frequency band represents an approximation to the human voice range, and therefore the bandpass filter 202 eliminates any noise outside this pass-band. The switching threshold of the Schmitt trigger 204 is set such that the Schmitt trigger 204 produces a pulse only when the initial voice signal exceeds a predetermined loudness level. In this manner, a shout of a passenger experiencing an emergency activates the intercom system 82, but normal conversational levels do not. The pulse produced by the Schmitt trigger 204 turns on the transistor 184 and energizes the relay coil 188 as previously discussed in conjunction with FIG. 6.

In lieu of or in addition to activating the intercom system 82, the embodiments of FIGS. 6 and 7 can be used to activate the microcomputer 58 illustrated in FIG. 2 and the various emergency programming modules associated therewith and illustrated in FIGS. 3, 4, and 5.

What is claimed is:

1. An emergency control system for use in an elevator system including a structure having a plurality of floors, an elevator car mounted for movement relative to the structure to serve the floors, a traffic director's station, a plurality of hall call selecting means mounted on each one of the plurality of landings, and landing selecting means and emergency stop button means mounted in the elevator car, said emergency control system comprising:

first means for storing a code word known only to users of the elevator system;

second means in the elevator car for producing an emergency signal in response to a vocal signal from an elevator passenger experiencing an emergency situation;

third means for comparing the code word in said memory means with said emergency signal and for producing a recognition signal when said emergency signal matches the code word;

and elevator control means for moving the elevator car to a predetermined one of the plurality of floors in response to said recognition signal.

2. The emergency control system of claim 1 including an alarm activated by the recognition signal and mounted at the traffic director's station.

3. The emergency control system of claim 1 including means for disabling the hall call selecting means in response to the recognition signal.

4. The emergency control system of claim 1 including means for disabling the landing selecting means in response to the recognition signal.

5. The emergency control system of claim 1 including means for disabling the emergency stop button means in response to the recognition signal.

6. The emergency control system of claim 1 wherein the second means includes a cardioid directional microphone.

7. The emergency control system of claim 1 including an intercom system having a first terminal in the elevator car and a second terminal at the traffic director's station to provide bidirectional communication between the elevator passenger and the traffic director's station, said intercom system being activated in response to the recognition signal.

* * * * *